US009536512B2

(12) United States Patent
Alu et al.

(10) Patent No.: US 9,536,512 B2
(45) Date of Patent: Jan. 3, 2017

(54) NON-RECIPROCAL ACOUSTIC DEVICES BASED ON LINEAR OR ANGULAR MOMENTUM BIASING

(71) Applicant: Board of Regents, The University of Texas System, Austin, TX (US)

(72) Inventors: Andrea Alu, Austin, TX (US); Romain Fleury, Austin, TX (US); Dimitrios Sounas, Austin, TX (US)

(73) Assignee: Board of Regents, The University of Texas System, Austin, TX (US)

( * ) Notice: Subject to any disclaimer, the term of this patent is extended or adjusted under 35 U.S.C. 154(b) by 0 days.

(21) Appl. No.: 14/913,240

(22) PCT Filed: Aug. 4, 2014

(86) PCT No.: PCT/US2014/049544

§ 371 (c)(1),
(2) Date: Feb. 19, 2016

(87) PCT Pub. No.: WO2015/026509

PCT Pub. Date: Feb. 26, 2015

(65) Prior Publication Data

US 2016/0203810 A1 Jul. 14, 2016

Related U.S. Application Data

(60) Provisional application No. 61/868,178, filed on Aug. 21, 2013.

(51) Int. Cl.
*G10K 11/04* (2006.01)

(52) U.S. Cl.
CPC ..... *G10K 11/04* (2013.01)

(58) Field of Classification Search
CPC ..... G10K 11/04
(Continued)

(56) References Cited

U.S. PATENT DOCUMENTS 2,812,032 A 11/1957 Kock
2,872,994 A 2/1959 Kock
(Continued)

FOREIGN PATENT DOCUMENTS

CN 103592019 2/2014

OTHER PUBLICATIONS

International Preliminary Report on Patentability for International Application No. PCT/US2014/049544 dated Feb. 23, 2016, pp. 1-11.

(Continued)

*Primary Examiner* — Forrest M Phillips
(74) *Attorney, Agent, or Firm* — Robert A. Voigt, Jr.; Winstead, P.C.

(57) ABSTRACT

A non-reciprocal acoustic device that accomplishes non-reciprocity via linear or angular-momentum bias. The non-reciprocal acoustic device includes an azimuthally symmetric or planar acoustical cavity (e.g., ring cavity), where the cavity is biased by imposing a circular or linear motion of a gas, a fluid or a solid medium filling the cavity. Acoustic waveguides are connected to the cavity or the cavity is excited from the surrounding medium. A port of this device is excited with an acoustic wave. When the cavity is biased appropriately, the acoustic wave is transmitted to one of the other acoustic waveguides while no transmission of the acoustic wave occurs at the other acoustic waveguides. As a result, linear non-reciprocity is now realized in acoustics without distorting the input signal or requiring high input power or bulky devices.

22 Claims, 8 Drawing Sheets

(58) Field of Classification Search
USPC ..... 181/182
See application file for complete search history.

(56) References Cited

U.S. PATENT DOCUMENTS

| | | | |
|---|---|---|---|
| 2003/0164661 | A1 | 9/2003 | Pfeifer |
| 2012/0186904 | A1 | 7/2012 | Cheng et al. |
| 2013/0033339 | A1 | 2/2013 | Boechler et al. |

OTHER PUBLICATIONS

Steven A. Cummer, "Selecting the Direction of Sound Transmission," Science, vol. 343, No. 495, Jan. 31, 2014, pp. 495-496.
Fleury et al., "Sound Isolation and Giant Linear Nonreciprocity in a Compact Acoustic Circulator," Science, vol. 343, Jan. 31, 2014, pp. 516-519.
International Search Report and Written Opinion for International Application No. PCT/US2014/049544 dated Feb. 12, 2015, pp. 1-15.
Fleury et al., "Non-Reciprocal Acoustic Devices Based on Spatio-Temporal Angular-Momentum Modulation," J. Acoust. Soc. Am.136, 2281 (2014), see Abstract, one page.

NON-RECIPROCAL ACOUSTIC DEVICES BASED ON LINEAR OR ANGULAR MOMENTUM BIASING

CROSS REFERENCE TO RELATED APPLICATIONS

This application claims priority to U.S. Provisional Patent Application Ser. No. 61/868,178, "Non-Reciprocal Acoustic Devices Based on Angular Momentum Biasing," filed on Aug. 21, 2013, which is incorporated by reference herein in its entirety.

GOVERNMENT INTERESTS

This invention was made with government support under Grant No. HDTRA1-12-1-0022 awarded by the Department of Defense/Department of Threat Reduction. The U.S. government has certain rights in the invention.

TECHNICAL FIELD

The present invention relates generally to non-reciprocal devices, and more particularly to non-reciprocal acoustic devices based on angular momentum biasing.

BACKGROUND

Non-reciprocity of wave propagation is a fascinating property of a medium originating from time-reversal symmetry breaking According to the Casimir-Onsager principle, for a device to be non-reciprocal, its scattering matrix must depend on an odd vector upon time-reversal. For instance, in such a non-reciprocal device (e.g., isolator, diode), the waves are totally transmitted in one direction and perfectly reflected in the other. Recently, a few proposals for achieving unidirectional sound propagation in linear devices have been discussed, but most of these concepts use an asymmetric linear structure without any type of odd-vector bias, making the device totally symmetric upon time-reversal, and therefore completely reciprocal. These linear devices behave as asymmetrical mode converters, rather than as isolators. These linear devices cannot be used for sound isolation because if the input and output are reversed, as required in a device having the purpose of a diode between two ports, the propagation is strictly reciprocal.

A viable solution to achieve acoustic non-reciprocity, suitable for isolation, is to use non-linear media. For instance, one can pair a phononic crystal and a non-linear medium capable of converting the frequency of the wave. From one side, the wave is reflected because the crystal is operating in the band gap. From the other side, the wave frequency is converted into a value in the propagation band of the crystal, and therefore transmitted through the structure. However, this solution requires very high input powers and makes it difficult to efficiently operate with the low-intensity signals typically encountered in linear acoustics. As an additional drawback, particularly problematic for sound waves, it drastically modifies the frequency of the signal. In principle though, non-reciprocal propagation in linear systems is allowed by the laws of physics. Magnetic bias can induce non-reciprocity, like in the case of the acoustic Faraday effect, but magneto-acoustic effects are relatively weak and would require large devices considerably bigger than the wavelength. Mechanical motion has been proposed to realize an acoustic gyrator (a non-reciprocal phase shifter), but as in the case of magnetic bias, the obtained device is very bulky and stringently limited to transverse waves on pipes. A solution for a linear, compact acoustic non-reciprocal device for longitudinal waves in a gas (e.g., air) is still missing and highly desirable for audible sound isolation.

BRIEF SUMMARY

In one embodiment of the present invention, a non-reciprocal device comprises an azimuthally symmetric acoustical cavity with an angular momentum bias. The non-reciprocal device further comprises a plurality of acoustic waveguides connected to the azimuthally symmetric acoustical cavity, where each of the plurality of acoustic waveguides is associated with an input and output port. Additionally, the non-reciprocal device comprises an input port of a first acoustic waveguide of the plurality of acoustic waveguides that is excited with an acoustic wave. The azimuthally symmetric acoustical cavity is biased in such a manner to induce total transmission of the acoustic wave to an output port of a second acoustic waveguide of the plurality of acoustic waveguides and no transmission of the acoustic wave to an output port of a third acoustic waveguide of the plurality of acoustic waveguides.

In another embodiment of the present invention, a non-reciprocal device comprises an acoustical cavity with an angular momentum bias, where the acoustical cavity is composed of sub-cavities coupled to each other and where the angular momentum bias is achieved by a temporal modulation of acoustical properties of the sub-cavities. The non-reciprocal device further comprises a plurality of acoustic waveguides connected to the acoustical cavity, where each of the plurality of acoustic waveguides is associated with an input and output port. Furthermore, the non-reciprocal device comprises an input port of a first acoustic waveguide of the plurality of acoustic waveguides is excited with an acoustic wave. The acoustical cavity is biased in such a manner to induce total transmission of the acoustic wave to an output port of a second acoustic waveguide of the plurality of acoustic waveguides and no transmission of the acoustic wave to an output port of a third acoustic waveguide of the plurality of acoustic waveguides.

In another embodiment of the present invention, a non-reciprocal device comprises an acoustical cavity, where the acoustical cavity is composed of a planar cavity in which a linear momentum bias is applied through a transversely moving medium or a temporal modulation. The non-reciprocal device further comprises a pair of acoustic waveguides connected to the acoustical cavity, where each of the pair of acoustic waveguides is associated with an input and output port. The non-reciprocal device additionally comprises an input port of a first acoustic waveguide of the pair of acoustic waveguides is excited with an acoustic wave. The acoustical cavity is biased in such a manner to induce total transmission of the acoustic wave excited at the input port of the first acoustic waveguide of the pair of acoustic waveguides to an output port of the second acoustic waveguide of the pair of acoustic waveguides, where the acoustical cavity is biased in such a manner to induce zero transmission of the acoustic wave excited at an input port of the second acoustic waveguide of the pair of acoustic waveguides to an output port of the first acoustic waveguide of the pair of acoustic waveguides.

In another embodiment of the present invention, a non-reciprocal device comprises an acoustical cavity, where the acoustical cavity is composed of a planar cavity in which a linear momentum bias is applied through a transversely moving medium or a temporal modulation and where the acoustical cavity is excited by acoustic waves propagating in free space. Faces of the acoustical cavity are partially-transparent in order to allow penetration of the acoustic waves into the acoustical cavity.

In a further embodiment of the present invention, an artificial acoustic medium made of a lattice of non-reciprocal devices, where the acoustic medium is rendered non-reciprocal by applying angular or linear momentum bias to each element of the lattice resulting in non-reciprocal propagation for both bulk modes and edge modes of the artificial acoustic medium.

The foregoing has outlined rather generally the features and technical advantages of one or more embodiments of the present invention in order that the detailed description of the present invention that follows may be better understood. Additional features and advantages of the present invention will be described hereinafter which may form the subject of the claims of the present invention.

BRIEF DESCRIPTION OF THE SEVERAL VIEWS OF THE DRAWINGS

A better understanding of the present invention can be obtained when the following detailed description is considered in conjunction with the following drawings, in which.

DETAILED DESCRIPTION

As stated in the Background section, a viable solution to achieve acoustic non-reciprocity, suitable for isolation, is to use non-linear media. For instance, one can pair a phononic crystal and a non-linear medium capable of converting the frequency of the wave. From one side, the wave is reflected because the crystal is operating in the band gap. From the other side, the wave frequency is converted into a value in the propagation band of the crystal, and therefore transmitted through the structure. However, this solution requires very high input powers and makes it difficult to efficiently operate with the low-intensity signals typically encountered in linear acoustics. As an additional drawback, particularly problematic for sound waves, it drastically modifies the frequency of the signal. In principle though, non-reciprocal propagation in linear systems is allowed by the laws of physics. Magnetic bias can induce non-reciprocity, like in the case of the acoustic Faraday effect, but magneto-acoustic effects are relatively weak and would require large devices considerably bigger than the wavelength. Mechanical motion has been proposed to realize an acoustic gyrator (a non-reciprocal phase shifter), but as in the case of magnetic bias, the obtained device is very bulky and stringently limited to transverse waves on pipes. A solution for a linear, compact acoustic non-reciprocal device for longitudinal waves in a gas (e.g., air) is still missing and highly desirable for audible sound isolation.

Figure 1A:
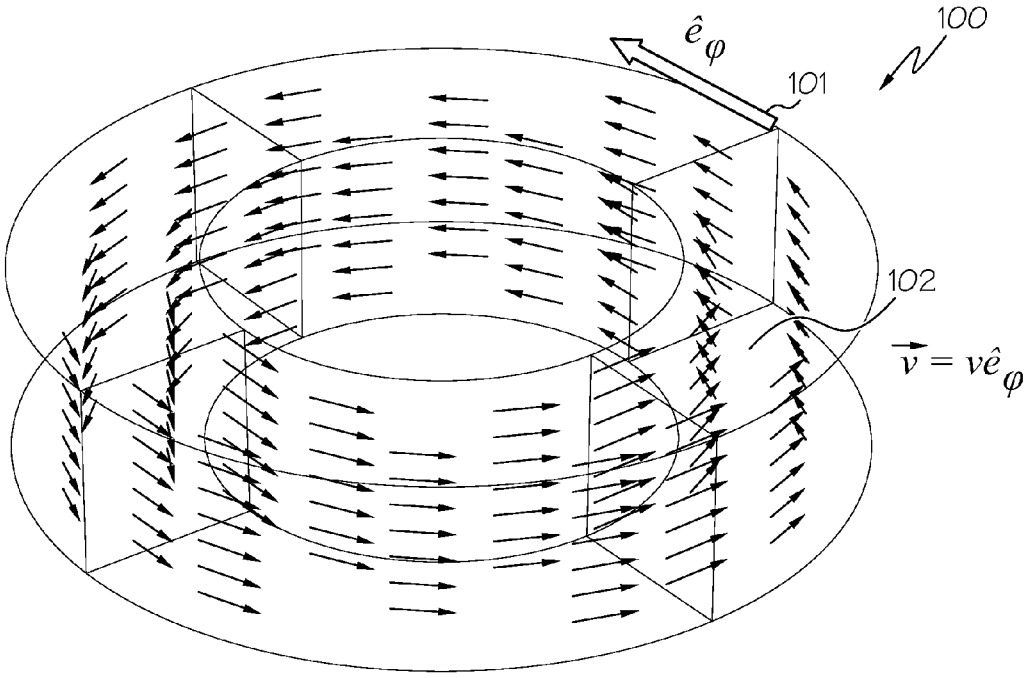
FIG. 1A illustrates an acoustic ring cavity biased by circulating the inside fluid in accordance with an embodiment of the present invention.
Figure 1B:
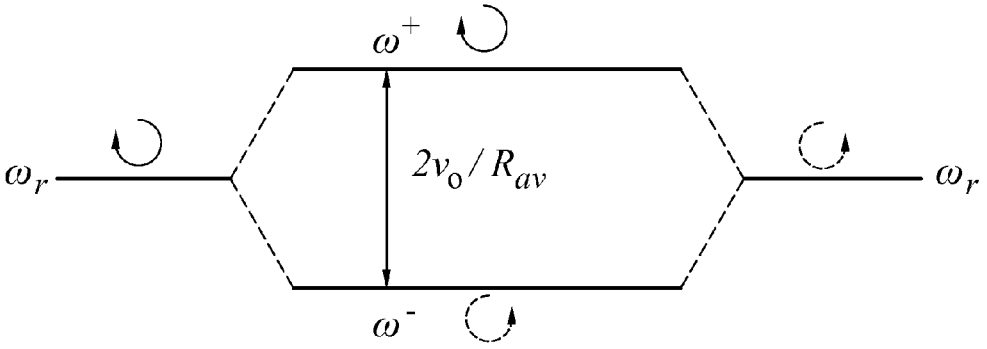
FIG. 1B illustrates the results in a splitting of the first counter-propagating eigenmodes, which is directly proportional to the bias velocity, according to the analytical model of the present invention in accordance with an embodiment of the present invention.
Figure 1C:
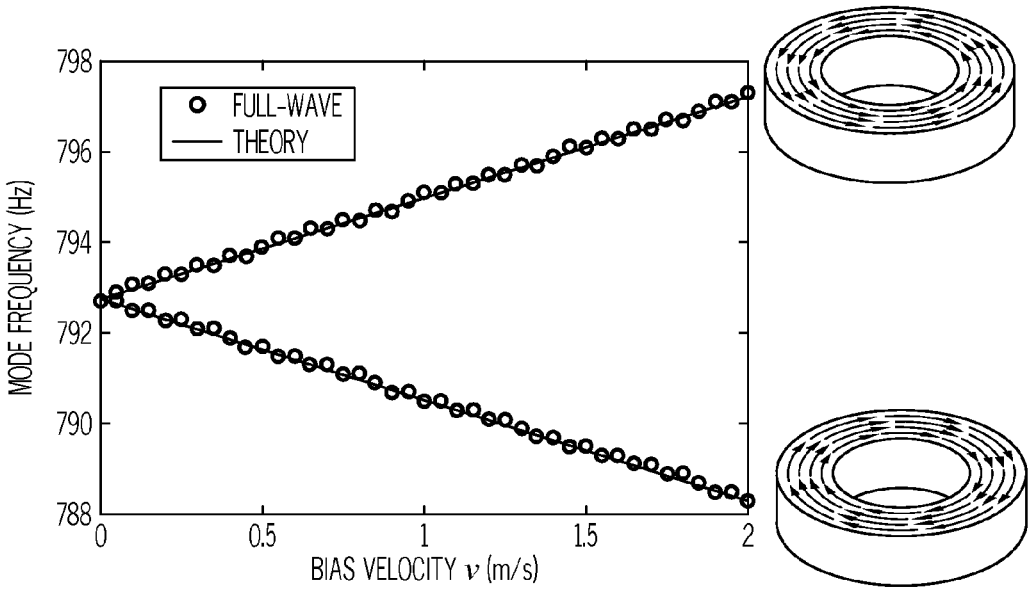
FIG. 1C illustrates the comparison between the analytical prediction and full-wave simulations, demonstrating the splitting of the eigenfrequencies associated with the right-handed and left-handed modes in accordance with an embodiment of the present invention.

The principles of the present invention provide a means for developing a linear non-reciprocal device, such as a linear acoustic diode or a linear acoustic isolator, for acoustic waves based on angular momentum biasing. As a result of the principles of the present invention, linear non-reciprocity is now realized in acoustics without distorting the input signal or requiring high input power or bulky devices. The method for developing such a non-reciprocal acoustic device is based on introducing an acoustic equivalent to the Zeeman effect, based on angular-momentum biasing a small circular cavity at resonance. Consider an azimuthally symmetric acoustical cavity, for instance a ring cavity 100 carved into a solid block as depicted in FIG. 1A in accordance with an embodiment of the present invention. Referring to FIG. 1A, cavity 100 is biased by imposing a circular motion 101 to the filling medium 102 (e.g., gas, such as air, a fluid, and a solid, such as a rubber ring in water) at a resonance frequency. The bias velocity is assumed to be azimuthally directed along $\vec{e}_\varphi$, and may depend on the radial distance r, although it is assumed, without loss of generality, that its magnitude is constant and equal to v. In the absence of external bias, ring cavity 100 resonates when its average circumference approximately equals an integer number m of the wavelength, supporting degenerate counter-propagating eigenmodes with azimuthal dependence $e^{\pm im\Phi}$. This implies that for the fundamental mode m=1 used in an embodiment of the present invention, the dimensions of ring cavity 100 are smaller than the wavelength. To understand the effect of the bias on the modal properties, consider the time-independent Schrodinger equation of the ring:

$$(H_0+P)|\psi\rangle=\omega|\psi\rangle, \tag{1}$$

where $|\psi\rangle$ is a modal state vector, w is the eigenfrequency, $H_0$ is the time-evolution operator of the system in absence of bias and P is an operator describing the perturbation due to the moving medium. This equation is derived assuming irrotational and isentropic flow. Neglecting the higher order modes, the two eigenvalues $\omega^+$ and $\omega^-$ are found as:

$$\omega^{\pm} = \omega_0 \pm \frac{v}{R_{av}}, \tag{2}$$

where $\omega_0$ is the degenerate resonance frequency of the fundamental mode in the absence of bias and $R_{av}$ is the average ring radius. As represented in FIG. 1B in accordance with an embodiment of the present invention, the bias breaks the degeneracy with a frequency splitting linear in velocity, analogous to the Zeeman effect for atomic electrons in the presence of a static magnetic field. If the velocity circulation is right-handed (RH), the left-handed (LH) mode shifts toward higher frequencies, while the RH mode is shifted down by the same amount. If the velocity circulation is LH, the RH mode shifts toward higher frequencies, while the LH mode is shifted down by the same amount. To validate our analytical model of this proposed acoustic Zeeman effect, the eigenvalue problem has been numerically solved for a biased cavity. The eigenvalues where found to be in perfect agreement with EQ (2), as illustrated in FIG. 1C in accordance with an embodiment of the present invention, validating the formalism and assumptions.

Figure 1D:
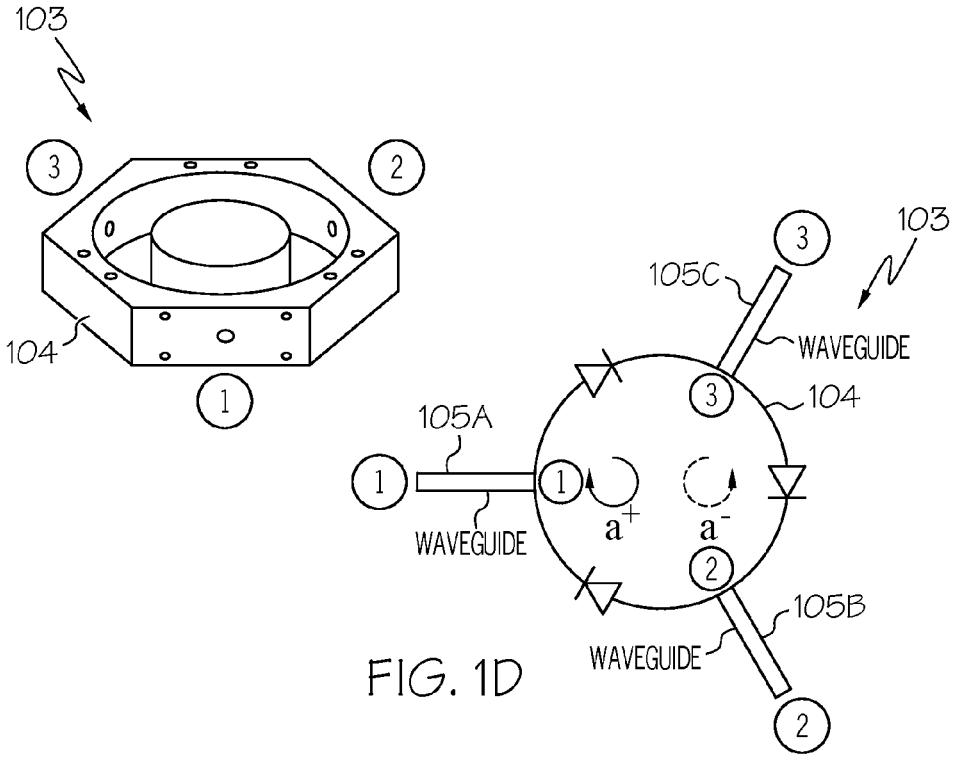
FIG. 1D illustrates a generalization of an acoustic diode to a three-port system composed of the biased ring cavity and three acoustic waveguides coupled to it in accordance with an embodiment of the present invention.

In ferromagnetic materials, the Zeeman effect is responsible for non-reciprocal propagation of electromagnetic waves. Because the space of the states of ring cavity 100 now depends on an odd vector upon time-reversal, i.e. the angular momentum of the moving medium, one would expect the proposed acoustic Zeeman effect to be capable of inducing non-reciprocity, just like its quantum counterpart for electromagnetic waves. In that regard, the principles of the present invention generalize the acoustic diode to a three-port linear device, also known as circulator. Such a device allows acoustic power incident at port 1 to be totally and solely transmitted at port 3. From port 3, the power goes to port 2, and from port 2 to port 1. The scattering matrix S for the circulator envisioned in FIG. 1D in accordance with an embodiment of the present invention is non-symmetrical, $$S = \begin{pmatrix} 0 & 1 & 0 \\ 0 & 0 & 1 \\ 1 & 0 & 0 \end{pmatrix}, \tag{3}$$

a symptom of its non-reciprocal nature. It is noted that the proposed diode of the present invention is a subsystem of an acoustic circulator, also a first of its kind for sound waves. Indeed, a diode can be readily obtained from the circulator by matching one of the ports, reducing the system to an input-output device capable of sound isolation. For example, as illustrated in FIG. 1D, such a device 103 includes an acoustic Zeeman cavity 104 (such as ring cavity 100) coupled via small holes to three acoustic waveguides 105A-105C placed at 120° around it. Each waveguide 105A-105C is associated with an input and output port, such as input/output ports 1-3, respectively, that can be used to input/output an acoustic wave to waveguide 105A-105C, respectively. Waveguides 105A-105C may collectively or individually be referred to as waveguides 105 or waveguide 105, respectively. Because of mode splitting, an acoustic wave incident at port 1 would unevenly couple to both RH and LH modes, with different amplitudes $a^+$ and $a^-$, allowing for interferences between them, and potentially different outcomes at ports 2 and 3. Using temporal coupled-mode theory, the power transmission coefficients at ports 2 and 3 are found to be:

$$T_{1\to 2} = \left|\frac{2}{3}\left(\frac{e^{i4\pi/3}}{1+i(\omega-\omega^+)/\gamma^+} + \frac{e^{i2\pi/3}}{1+i(\omega-\omega^-)/\gamma^-}\right)\right|^2, \tag{4}$$

$$T_{1\to 3} = \left|\frac{2}{3}\left(\frac{e^{i2\pi/3}}{1+i(\omega-\omega^+)/\gamma^+} + \frac{e^{i4\pi/3}}{1+i(\omega-\omega^-)/\gamma^-}\right)\right|^2, \tag{5}$$

where we have noted $\gamma^{\pm}$ the decay rates associated with the RH and LH modes. From EQ(4) and EQ(5), it is evident that if the modes of a cavity 104 coupled to three waveguides 105 can be split such that $\omega^{\pm}=\omega\ \gamma\gamma\pm/\sqrt{3}$, one can obtain $T_{1\to 2}=0$, and $T_{1\to 3}=1$, and by symmetry, the entire scattering matrix of EQ(3). Hence, this proves that with the acoustic Zeeman effect, an acoustic circulator with a linear subwavelength non-reciprocal response is possible.

Numerous simulations have been performed to investigate the behavior of the three port system 103 of FIG. 1D when an acoustic wave is incident from port 1. The results are summarized in FIGS. 2A-2E in accordance with an embodiment of the present invention. FIGS. 2A-2E will now be discussed in conjunction with FIG. 1D.

Figure 2A:
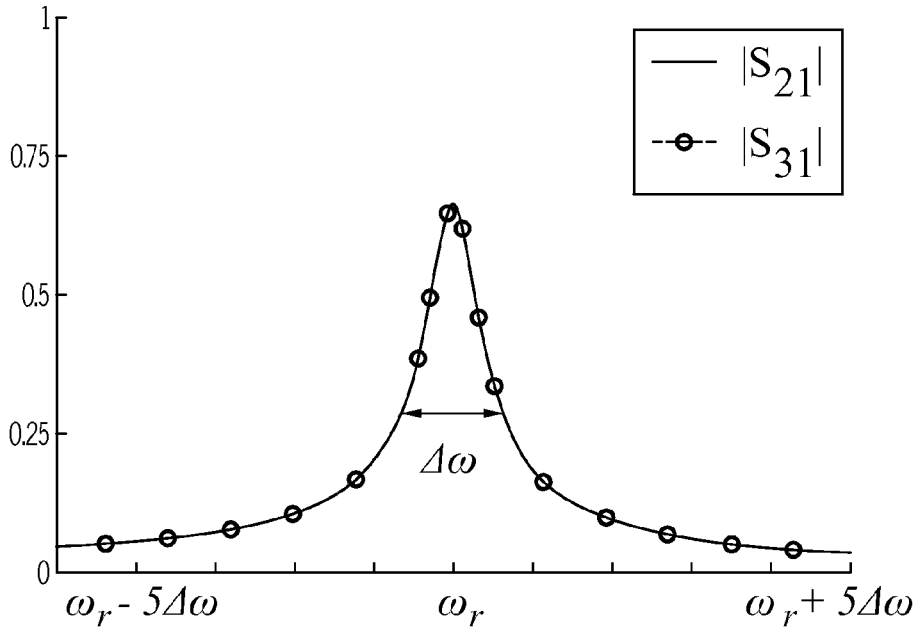
FIG. 2A illustrates that the transmission spectrum at ports 2 and 3 are identical when there is no bias applied to the acoustic circulator of FIG. 1D in accordance with an embodiment of the present invention.

Referring to FIG. 2A, which depicts the case of not biasing the system 103 of FIG. 1D, the magnitude of the pressure transmission coefficient is calculated at ports 2 and 3 when no bias is applied. In that case, the transmission coefficients at ports 2 and 3 are identical, consistent with the symmetry of device 103. System 103 is a power divider, which sends ⅔ of the power in each of the output port (e.g., ports 2 and 3), the remaining (⅓) being reflected.

Figure 2B:
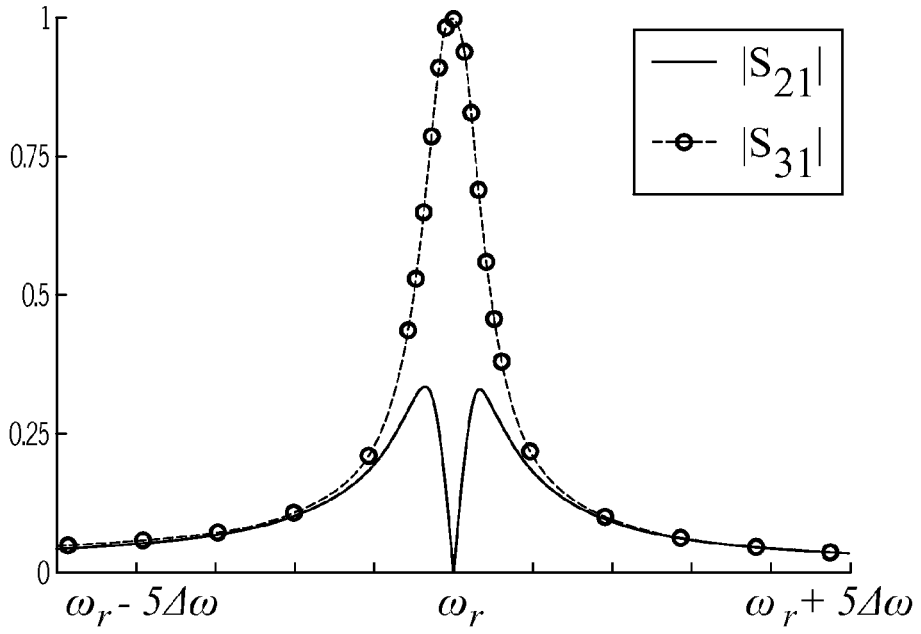
FIG. 2B illustrates that zero transmission is obtained at port 2 and total transmission is obtained at port 3 at the resonance frequency by tailoring the bias velocity to the acoustic circulator of FIG. 1D in accordance with an embodiment of the present invention.

FIG. 2B shows the altered transmission spectrum when device 103 is appropriately biased in accordance with an embodiment of the present invention. The transmission to port 2 dramatically goes down to zero at a specific frequency. At the same frequency, the transmission to port 3 reaches unity, indicating that all the energy is directed to port 3. Similarly, when an acoustic wave is incident from port 3, the acoustic wave was sent to port 2 instead of coming back to port 1, as one would expected if device 103 was reciprocal. Similarly, excitation from port 2 leads to total transmission at port 3.

Figure 2C:
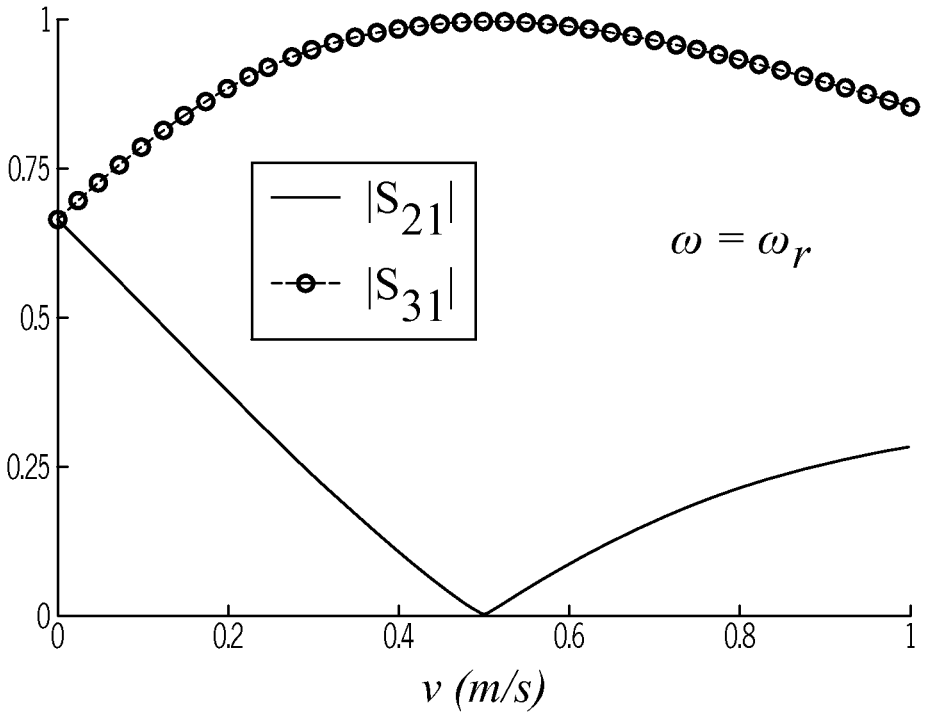
FIG. 2C illustrates the effect of varying the bias velocity on the non-reciprocal transmission properties of the device of FIG. 1D in accordance with an embodiment of the present invention.

FIG. 2C illustrates the effect of varying the bias velocity on the transmission from port 1 to port 2 and port 3 in accordance with an embodiment of the present invention. When the velocity is zero (unbiased device), the amplitude transmission coefficient is equal to ⅔. As the velocity is increased, the transmission to port 2 gradually goes down to zero, while at port 3 it increases to reach one for a specific value of the bias velocity. This value provides the correct amount of acoustic Zeeman splitting to obtain a perfect circulator. Past this value, the S-parameter $|S_{21}|$ increases again while $|S_{31}|$ decreases. Interestingly, the method is quite robust to fluctuations in the mean velocity value. Indeed, a high degree of isolation is obtained, defined as the ratio $|S_{31}/S_{21}|$, in a large range of velocities around the optimal value.

Figure 2D:
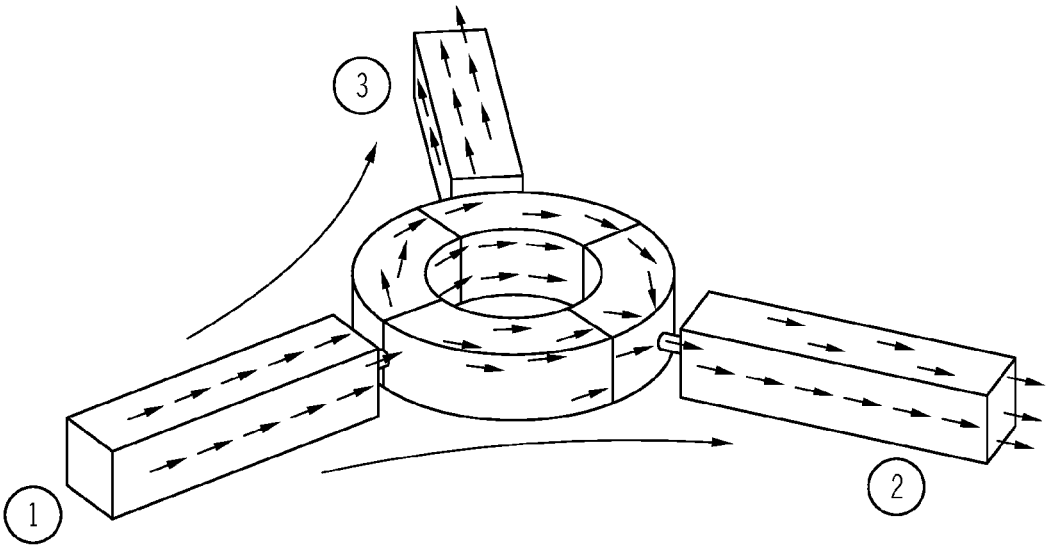
FIG. 2D illustrates the acoustic pressure field distributed inside the unbiased device of FIG. 1D in accordance with an embodiment of the present invention.
Figure 2E:
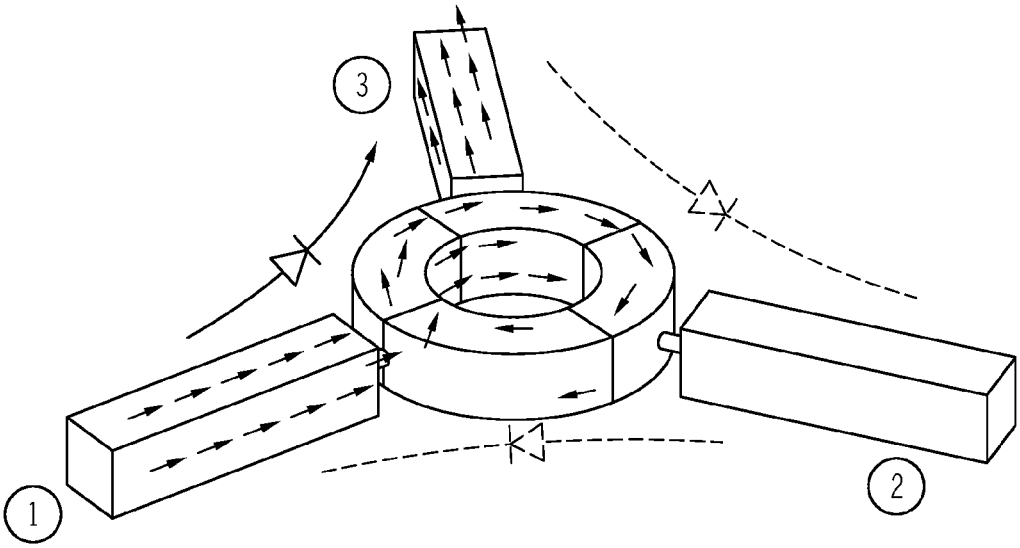
FIG. 2E illustrates that the acoustic wave is fully transmitted in the third waveguide while the sound level in the second waveguide is zero when the device of FIG. 1D is biased appropriately in accordance with an embodiment of the present invention.

To get more insight into the behavior of the acoustic pressure field inside device 103, the acoustic pressure field distribution under the unbiased operation and under the optimum velocity bias is shown in FIGS. 2D and 2E, respectively, in accordance with an embodiment of the present invention. Under the unbiased operation, as shown in FIG. 2D, the modes are degenerate and evenly excited, resulting in a field distribution inside the cavity that is totally symmetrical with respect to the axis of port 1. Ports 2 and 3, which are symmetrical with respect to the port 1 axis, are evenly excited, and non-reciprocal propagation is totally out of the picture. The average power flow, represented by the black arrows, is split evenly between the two output ports (ports 2 and 3). When device 103 is properly biased however, the split modes are excited in different ways and interfere, leading to a field distribution that is no longer symmetrical with respect to the port 1 axis. It is clear from the plot of FIG. 2E that a destructive interference occurs at port 2, while at port 3 the modes interfere constructively, explaining the peculiar non-reciprocal response. The power flow is fully and consistently routed to only the left output port (port 3).

Figure 3A:
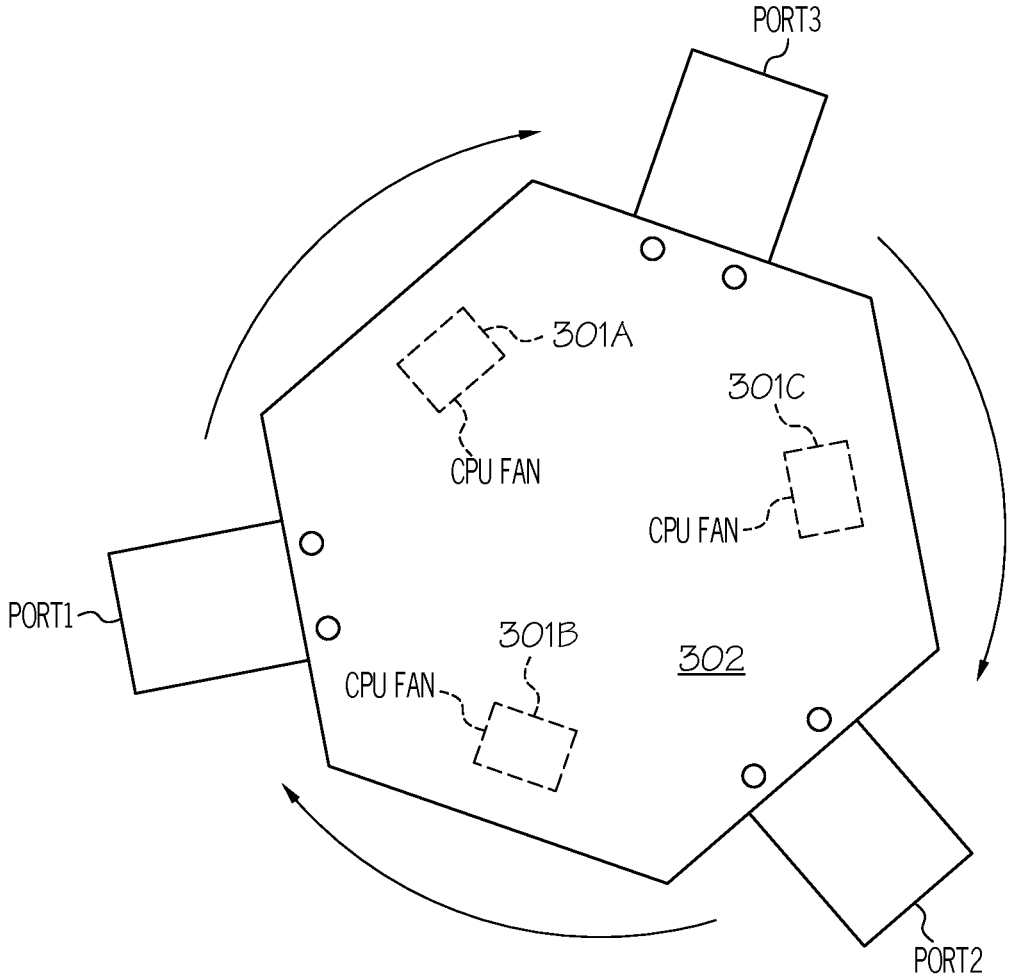
FIG. 3A illustrates a fabricated device incorporating the principles of the present invention in accordance with an embodiment of the present invention.
Figure 3B:
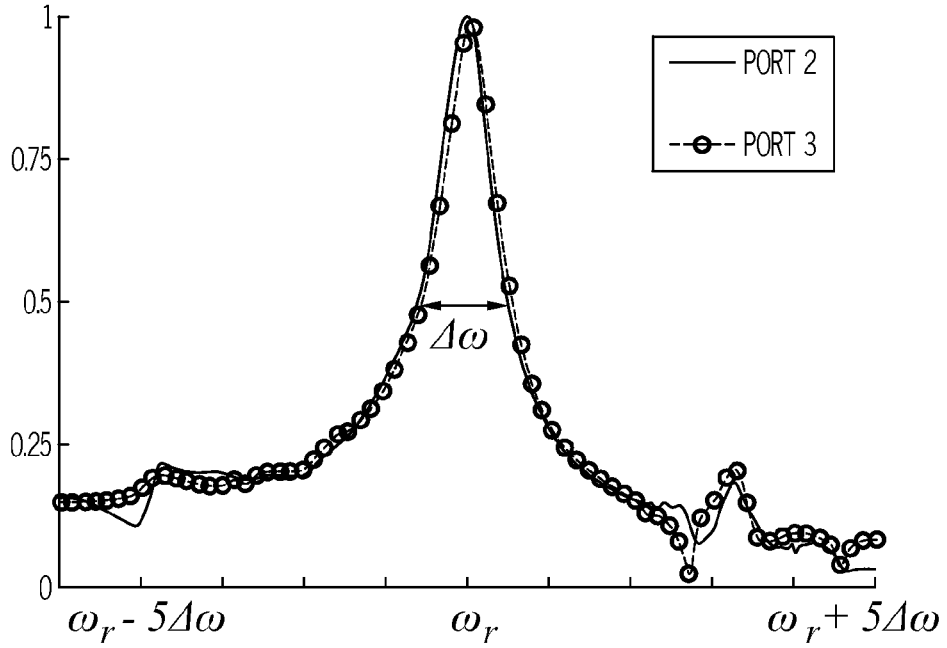
FIG. 3B illustrates measuring the sound transmission to ports 2 and 3 from a sound wave incident from port 1 when fans are not powered in accordance with an embodiment of the present invention.
Figure 3C:
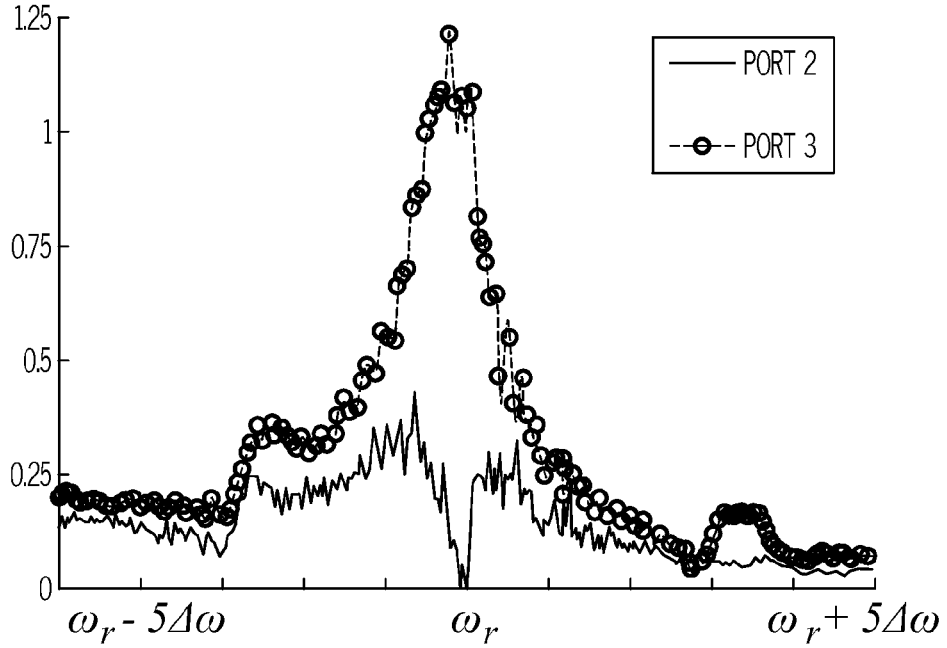
FIG. 3C illustrates measuring the sound transmission to ports 2 and 3 from a sound wave incident from port 1 when the fan velocity is adjusted to produce optimized non-reciprocal behavior in accordance with an embodiment of the present invention.
Figure 3D:
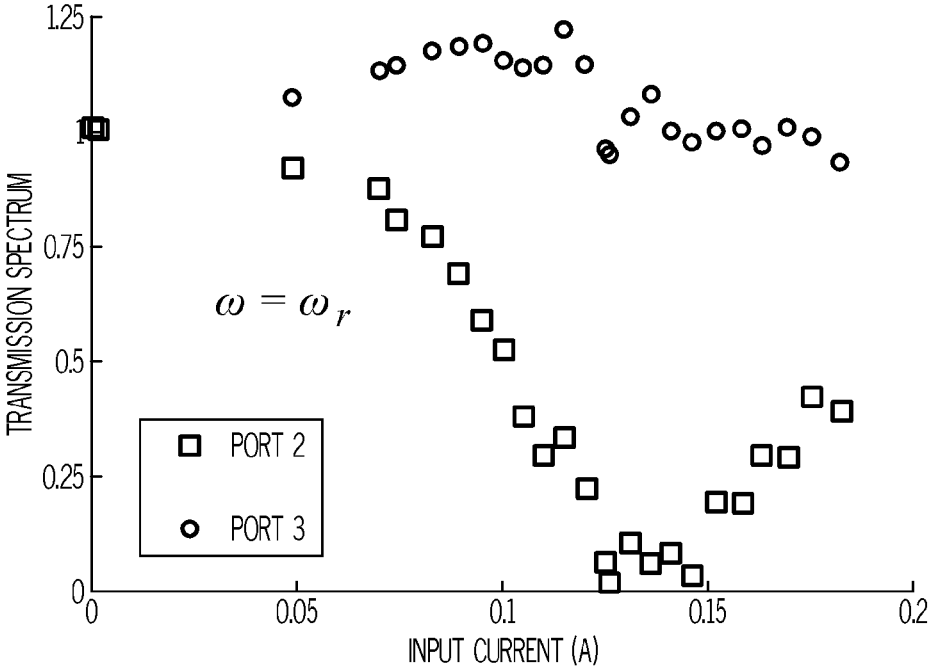
FIG. 3D illustrates the measured transmission spectrum normalized to the unbiased case, as a function of the input current, which is proportional to the fan speed in accordance with an embodiment of the present invention.
Figure 3E:
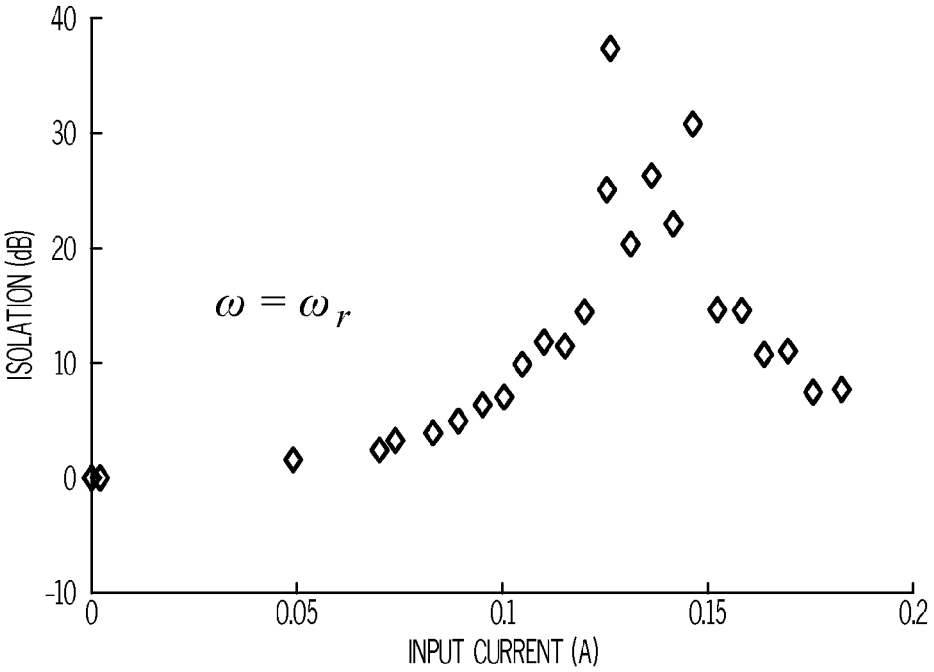
FIG. 3E illustrates the measured isolation in decibels as a function of the input current showing giant (>30 dB) amount of non-reciprocity at the design velocity in accordance with an embodiment of the present invention.

A device 300 fabricated using the principles of the present invention is shown in FIG. 3A in accordance with an embodiment of the present invention. In one embodiment, three low-noise CPU cooling fans 301A-301C, placed in the cavity 302 at 120° intervals, generate the circulating flow, aiming at operation in the audible range, around 800 Hz. Fans 301A-301C may collectively or individually be referred to as fans 301 or fan 301, respectively. By varying the input current of fans 301, the bias velocity of the cavity 302 is varied. Device 300 is excited by a loudspeaker placed upstream, such as in port 1. FIGS. 3B and 3C illustrate the measured transmission spectrum at port 2 and port 3, respectively, normalized to the case (FIG. 3B) of no bias in accordance with an embodiment of the present invention. In FIG. 3C, the input current was set to 130 mA, and non-reciprocity was observed very clearly, in excellent agreement with the theory. FIG. 3D illustrates the effect of varying the fan input current, i.e. the fan speed, on the transmission coefficients in accordance with an embodiment of the present invention. The experimental measures corroborate nicely the prediction of the theory of FIG. 2C. To quantify the performance of device 300, the amount of non-reciprocity characterized by the isolation $|S_{31}/S_{21}|$ as a function of the input current is measured as shown in FIG. 3E in accordance with an embodiment of the present invention. Using the principles of the present invention, a giant isolation of more than 30 dB around the optimal bias value was obtained. During the experiments, the response of device 300 was tested to excitation at the other ports. As expected from the 120° symmetry, the results were consistent with the one obtained from exciting port 1. Since the bias is electronically controlled, allowing a high degree of tunability, it is possible to instantaneously switch from reciprocal to non-reciprocal operation, and even reverse the handedness of the circulator by changing the sign of the input current. Narrow band signals were sent at co, and non-reciprocity was audible to an observer.

While FIGS. 3A-3E discuss using three low-noise CPU cooling fans 301 to achieve angular momentum bias by imparting a circular flow of air filling cavity 302, the principles of the present invention may use other means to achieve angular momentum bias, such as by using a stirrer to impart a circular flow of fluid filling the cavity. Furthermore, the non-reciprocal device may include an acoustical cavity with an angular momentum bias, where the acoustical cavity is composed of a sub-cavities coupled to each other and where the angular momentum bias is achieved by a temporal modulation of the acoustical properties of the sub-cavities. Additionally, the non-reciprocal device may include an acoustical cavity, where the acoustical cavity is composed of a planar cavity in which a linear momentum bias is applied through a transversely moving medium or a temporal modulation.

In all branches of wave physics, subwavelength wave manipulation is definitely challenging, and yet extremely desirable, due to the compactness of the associated devices. The subwavelength acoustic diode of the present invention may be used in practical integrated and tunable devices to achieve giant acoustic isolation at audible frequencies. The acoustic Zeeman effect, based on angular momentum biasing of a subwavelength ring cavity, may open new venues to tame the propagation of airborne acoustic waves in a new generation of acoustic switches, noise control devices, or imaging systems.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

The invention claimed is:

1. A non-reciprocal device comprising:

an azimuthally symmetric acoustical cavity with an angular momentum bias;

a plurality of acoustic waveguides connected to said azimuthally symmetric acoustical cavity, wherein each of said plurality of acoustic waveguides is associated with an input and output port; and an input port of a first acoustic waveguide of said plurality of acoustic waveguides is excited with an acoustic wave;

wherein said azimuthally symmetric acoustical cavity is biased in such a manner to induce total transmission of said acoustic wave to an output port of a second acoustic waveguide of said plurality of acoustic waveguides and no transmission of said acoustic wave to an output port of a third acoustic waveguide of said plurality of acoustic waveguides.

2. The non-reciprocal device as recited in claim 1, wherein said angular momentum bias is achieved by a circular motion of a fluid filling said azimuthally symmetric acoustical cavity.

3. The non-reciprocal device as recited in claim 1, wherein said angular momentum bias is achieved by a circular motion of a solid medium filling said azimuthally symmetric acoustical cavity.

4. The non-reciprocal device as recited in claim 1, wherein said angular momentum bias is achieved by a circular motion of a gas filling said azimuthally symmetric acoustical cavity.

5. The non-reciprocal device as recited in claim 4, wherein said gas comprises air.

6. The non-reciprocal device as recited in claim 1, wherein said angular momentum bias is achieved by fans imparting a circular flow of air filling said azimuthally symmetric acoustical cavity.

7. The non-reciprocal device as recited in claim 1, wherein said angular momentum bias is achieved by a stirrer imparting a circular flow of fluid filling said azimuthally symmetric acoustical cavity.

8. The non-reciprocal device as recited in claim 1, wherein said angular momentum bias removes a frequency degeneracy of right and left-handed resonances of said azimuthally symmetric acoustical cavity.

9. The non-reciprocal device as recited in claim 1, wherein said plurality of acoustic waveguides comprises three acoustic waveguides.

10. The non-reciprocal device as recited in claim 9, wherein said three acoustic waveguides are placed at 120 degrees around said azimuthally symmetric acoustical cavity.

11. The non-reciprocal device as recited in claim 1, wherein said non-reciprocal device has a functionality of a three-port acoustical diode.

12. The non-reciprocal device as recited in claim 1, wherein said non-reciprocal device has a functionality of an acoustical isolator.

13. The non-reciprocal device as recited in claim 1, wherein said azimuthally symmetric acoustical cavity is implemented in a form of a ring.

14. The non-reciprocal device as recited in claim 1, wherein said angular momentum bias is achieved by a spatio-temporal modulation of an acoustic medium filling said azimuthally symmetric acoustical cavity.

15. A non-reciprocal device comprising:

an acoustical cavity with an angular momentum bias, wherein said acoustical cavity is composed of sub-cavities coupled to each other, wherein said angular momentum bias is achieved by a temporal modulation of acoustical properties of said sub-cavities;

a plurality of acoustic waveguides connected to said acoustical cavity, wherein each of said plurality of acoustic waveguides is associated with an input and output port; and an input port of a first acoustic waveguide of said plurality of acoustic waveguides is excited with an acoustic wave;

wherein said acoustical cavity is biased in such a manner to induce total transmission of said acoustic wave to an output port of a second acoustic waveguide of said plurality of acoustic waveguides and no transmission of said acoustic wave to an output port of a third acoustic waveguide of said plurality of acoustic waveguides.

16. A non-reciprocal device comprising:

an acoustical cavity, wherein said acoustical cavity is composed of a planar cavity in which a linear momentum bias is applied through a transversely moving medium or a temporal modulation;

a pair of acoustic waveguides connected to said acoustical cavity, wherein each of said pair of acoustic waveguides is associated with an input and output port; and an input port of a first acoustic waveguide of said pair of acoustic waveguides is excited with an acoustic wave;

wherein said acoustical cavity is biased in such a manner to induce total transmission of said acoustic wave excited at said input port of said first acoustic waveguide of said pair of acoustic waveguides to an output port of said second acoustic waveguide of said pair of acoustic waveguides, wherein said acoustical cavity is biased in such a manner to induce zero transmission of said acoustic wave excited at an input port of said second acoustic waveguide of said pair of acoustic waveguides to an output port of said first acoustic waveguide of said pair of acoustic waveguides.

17. A non-reciprocal device comprising:

an acoustical cavity, wherein said acoustical cavity is composed of a planar cavity in which a linear momentum bias is applied through a transversely moving medium or a temporal modulation, wherein said acoustical cavity is excited by acoustic waves propagating in free space, wherein faces of said acoustical cavity are partially-transparent in order to allow penetration of said acoustic waves into said acoustical cavity.

18. The non-reciprocal device as recited in claim 17, wherein said acoustic waves propagate along opposite directions.

19. The non-reciprocal device as recited in claim 18, wherein said bias is applied in such a manner as to induce total transmission for a first acoustic wave propagating along one direction and total reflection for a second acoustic wave propagating along the opposite direction.

20. The non-reciprocal device as recited in claim 17, wherein said acoustic waves propagate along specular directions with respect to a normal direction to said faces of said acoustical cavity.

21. The non-reciprocal device as recited in claim 20, wherein said bias is applied in such a manner as to induce transmission for a first acoustic wave propagating along one direction and total reflection for a second acoustic wave propagating along the other direction.

22. An artificial acoustic medium made of a lattice of non-reciprocal devices, wherein said acoustic medium is rendered non-reciprocal by applying angular or linear momentum bias to each element of said lattice resulting in non-reciprocal propagation for both bulk modes and edge modes of said artificial acoustic medium.

* * * * *